United States Patent [19]

Briscoe et al.

[11] Patent Number: 4,597,713

[45] Date of Patent: Jul. 1, 1986

[54] SHOVEL DIPPER BAIL ASSEMBLY

[75] Inventors: Terry L. Briscoe, Portland; Rebecca A. H. VanRaden, Beaverton, both of Oreg.

[73] Assignee: Esco Corporation, Portland, Oreg.

[21] Appl. No.: 728,326

[22] Filed: Apr. 29, 1985

[51] Int. Cl.[4] ..... E02F 3/40

[52] U.S. Cl. ..... 414/690; 414/722

[58] Field of Search ..... 414/690, 693, 691, 692, 414/726, 722

[56] References Cited

U.S. PATENT DOCUMENTS 1,609,372 12/1926 Lichtenberg ..... 414/726
2,034,854 3/1936 Younie ..... 414/722
2,478,643 8/1949 Smart et al. ..... 414/692
2,947,430 8/1960 Schneider ..... 414/690

FOREIGN PATENT DOCUMENTS 3165 of 1914 United Kingdom ..... 414/693

*Primary Examiner*—Clifford D. Crowder
*Attorney, Agent, or Firm*—Tilton, Fallon, Lungmus & Chestnut

[57] ABSTRACT

A shovel dipper bail assembly including a bail having a central cylindrical portion and a lifting hitch rotatably connected to the cylindrical portion, the hitch assembly extending only slightly above the cylindrical portion and having lift cable connection means on opposite sides of the bail.

6 Claims, 4 Drawing Figures

SHOVEL DIPPER BAIL ASSEMBLY

BACKGROUND AND SUMMARY OF INVENTION

This invention relates to a shovel dipper bail assembly and, more particularly, to an assembly which permits the dipper to be raised higher on a given machine before it interferes with the boom tip sheaves than prior assemblies.

Power shovels have been employed in excavating since before the turn of the century, viz., steam shovels. Over all of these years, it is apparent that many design improvements have been made but a long-standing problem has resided in the inability of raising the dipper to the maximum height possible.

Conventionally, a power shovel includes a lifiting boom mounted on the prime mover and, intermediate the length of the boom, the dipper stick is pivotally mounted thereon. The outer end of the boom is equipped with cable sheaves and cables are entrained therein for connection with the bail of the dipper. The cables are connected to the bail of the dipper by means of a hitch assembly which heretofore has limited the height to which the dipper can be elevated. For example, in co-owned, expired U.S. Pat. No. 2,034,854, a lifting hitch is seen that projects substantially above the bight of the U-shaped bail. Such an arrangement has been generally employed down to the present where padlock lugs have been welded to the bail bight in order to provide a pivotal mounting for the hitch.

Over the years, other expedients have been attempted to increase the ability to elevate the dipper. It will be appreciated that the higher the dipper can be raised—relative to the lifting boom—the higher the bank in which the machine can be operated and it is also possible to dump from higher heights to suit larger trucks—thereby extending the performance capability range of a given machine. One expedient has consisted of "D-rings" which permitted the cable connection to the bail to be substantially at the bight level, but this expedient was rejected by the excavating art because it resulted in accelerated wear on the lifting cables.

According to the instant invention, we have achieved the goal of substantially maximum elevatability without the attendant disadvantages of the previously employed D-ring construction by utilizing a lift hitch assembly which is rotatably mounted on a cylindrical section of the bail bight. Advantageously, the cable connections are in the form of the well-known D-rings so as to provide a profile of lifting hitch which is just slightly above the bail—thereby enabling the dipper to be raised to maximum possible elevation. Even though the art workers knew of the D-ring connnections for lifting cables, and also had central cylindrical sections on the bail bights, no one was able to bring these two concepts together to provide the advantage of maximum elevatability of the dipper.

Other objects and advantages of the invention may be seen in the details of the ensuing specification.

The invention is described in conjunction with the accompanying drawing, in which FIG. 1 is a schematic elevational view, partially in section, of the forward (working) end of a power shovel;

DETAILED DESCRIPTION

Figure 1:
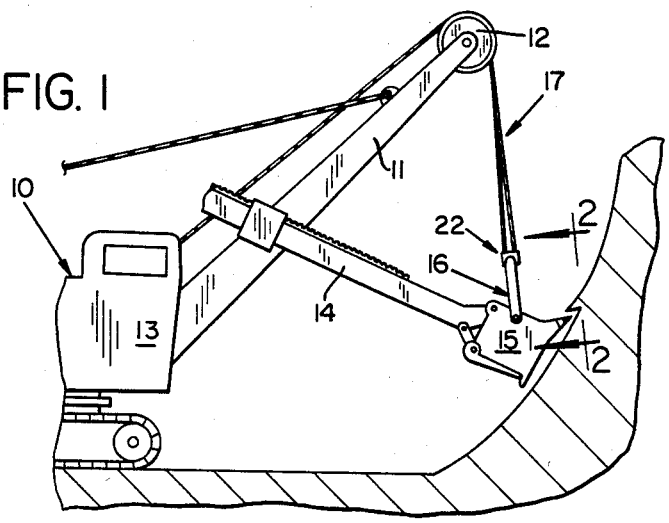

In the illustration given and with reference first to FIG. 1, the numeral 10 designates generally a power shovel equipped with a lifting boom 11 having cable sheaves 12 at the outer boom end, the inner end of the boom being mounted in the cab 13.

A dipper stick 14 equipped with a dipper 15 at the outer end thereof is pivotally mounted on the boom 11 and is equipped with a bail 16. Lifting cables generally designated 17 are connected between the bail and are entrained over the sheaves 12 for connection to a winch (not shown) within the prime mover of the power shovel 10. This environmental description for the invention is generally conventional and has been utilized in the construction of power shovels for many years.

BAIL

Figure 2:
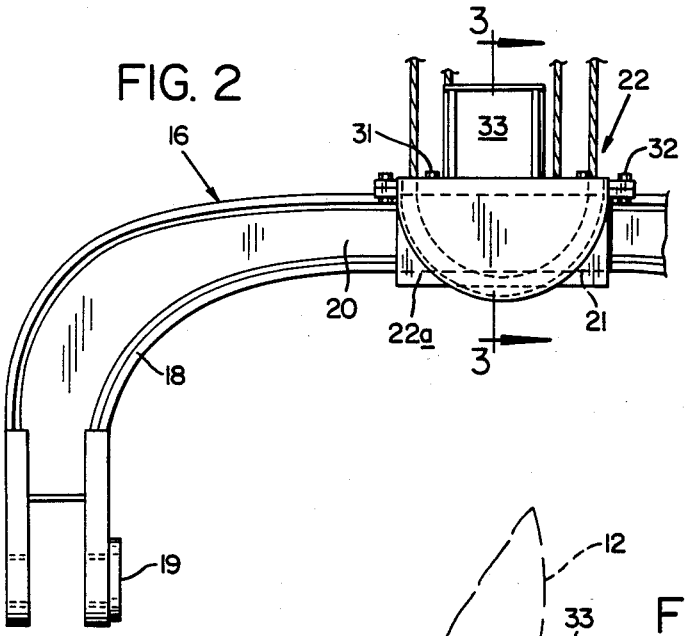
FIG. 2 is an enlarged fragmentary view taken along the sight line 2—2 of FIG. 1 and which essentially shows the inventive bail assembly in front elevation.

The bail 16 can be seen in enlarged form in FIG. 2 and includes a generally U-shaped member—the bail being shown only fragmentarily in order to conserve drawing space. The bail 16 includes a pair of legs 18 which are equipped with pivotal connections at the lower ends thereof as at 19 for pivotal engagement with the sides of the dipper 15. The bail further includes an integral, connecting bight 20 extending between the two depending legs 18.

Figure 3:
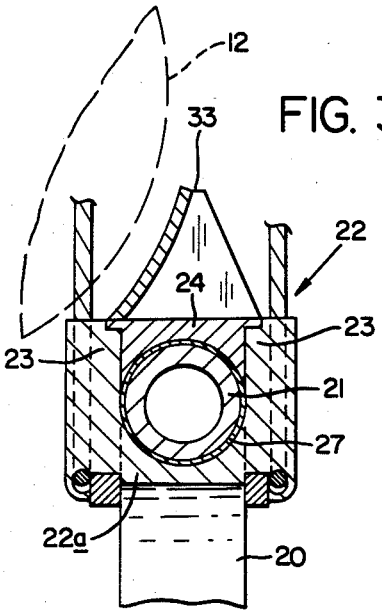
FIG. 3 is a fragmentary sectional view taken along the sight line 3—3 applied to FIG. 2.

The bight 20 has a central cylindrical portion 21 which can be best appreciated from a consideration of the central portion of FIG. 3. Advantageously, the bail can be cast or formed to provide such a central cylindrical section. Rotatably mounted on the bail central cylindrical section is a lifting hitch generally designated 22.

LIFTING HITCH

Figure 4:
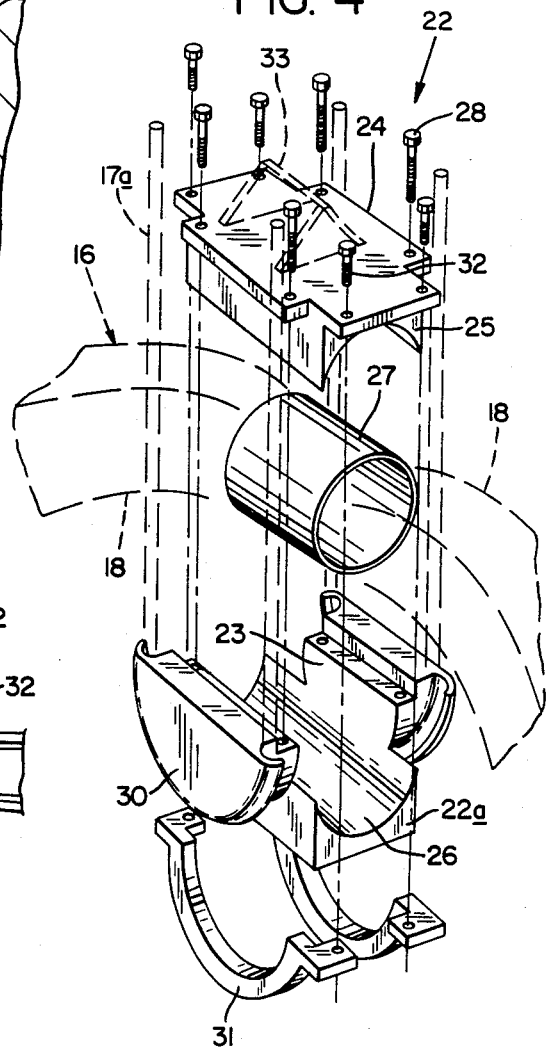
FIG. 4 is an exploded perspective view of the lifting hitch of the invention shown in conjunction with a fragment of a bail illustrated in dashed line.

The parts of the lifting hitch can be appreciated best from a consideration of FIG. 4 where the same are shown in exploded form. In FIG. 4, the numeral **22*a*—see the lower right hand portion—designates a generally U-shaped bracket which partially encircles the central cylindrical portion 21 of the bight 20. The bracket 22*a* has a pair of upstanding arms as at 23 and is closed across the top thereof by means of a closure 24—see the upper portion of FIG. 4**.

In the illustration given, the closure 24 is equipped with a depending portion 25 which is internally contoured to a segmental cylindrical configuration. In like fashion, the bracket **22*a* is similarly contoured as at 26. These provide complementary surfaces for the mounting of a split cylindrical bearing 27 which encircles the central cylindrical section 21 of the bight 20. In the illustration given four bolts 28 are employed to secure the closure 24 to the bracket 22*a***.

Each of the arms 23 of the bracket **22*a* are equipped on the outer sides thereof—relative to the bight 20—with a D-ring as at 30. The D-ring is essentially a half sheave and receives the looped bottom end of a cable such as that designated 17*a* in FIG. 4. The open bottom side of each D-ring is closed by an arcuate member 31 which is boltably secured to the closure 24 by means of bolts 32**.

Provided on the upper surface of the closure 24 is a bumper means 33 which can be seen in FIG. 3 to be coming into close proximity to the boom sheaves 12—the bumper means being advantageously arcuately curved as seen in FIG. 3 corresponding to the curvature of the sheave means 12.

Through the use of the invention, several significant advantages are achieved. These include reduced weight, reduced maintenance on rope and fewer bushed pivot points and the ability to raise the dipper closer to the machine boom sheave for material loading ease and clearance over trucks.

While in the foregoing specification a detailed description of an embodiment of the invention has been set down for the purpose of understanding, many variations in the details herein given may be made by those skilled in the art without departing from the spirit and scope of the invention.

We claim:

1. A shovel dipper bail assembly comprising a U-shaped bail adapted to be pivotally secured to a dipper, said bail having a pair of legs integral with a connecting bight, said bight centrally of the length thereof having a cylindrical section, and a lifting hitch for said dipper adapted to be cable-connected to a sheave-equipped boom, said hitch including a U-shaped bracket rotatably engaging said cylindrical section, said bracket having a pair of arms, cable sheave means mounted on said arms, and a closure connected between said arms to confine said bight cylindrical section within said hitch.

2. The assembly of claim 1 in which said closure is equipped with bumper means for engaging said boom sheave when said dipper is raised to maximum elevation.

3. The assembly of claim 1 in which each of said bracket and closure are equipped with confronting segmental cylindrical surfaces interiorly thereof, and a sleeve bearing interposed between said surfaces and said bight cylindrical section.

4. The assembly of claim 1 in which said cable sheave means includes a D ring on each of said bracket arms for receipt of a looped cable.

5. The assembly of claim 4 in which an arcuate member is releasably secured to said hitch exteriorly of each D-ring to provide a reeve-way for said looped cable.

6. A shovel dipper bail assembly comprising a bail having a central cylindrical portion and a lifting hitch rotatably connected to said cylindrical portion, said hitch assembly extending only slightly above said cylindrical portion and having lift cable connection means on opposite sides of said bail whereby a dipper is enabled to be brought into close proximity to the cable boom, said lift cable connection means including a generally half sheave on each side of said cylindrical portion, each said sheave adapted to provide a reeve-way for a looped cable.

* * * * *